US007735688B2

(12) United States Patent
Foster et al.

(10) Patent No.: US 7,735,688 B2
(45) Date of Patent: Jun. 15, 2010

(54) ROTATING COLLAR AND LOCKING AND VENTING CLOSURE CONNECTOR FOR AN AIR FOAMING PUMP DISPENSER

(75) Inventors: Donald D. Foster, St. Charles, MO (US); Philip L. Nelson, Wildwood, MO (US)

(73) Assignee: Meadwestvaco Calmar, Inc., Grandview, MO (US)

( * ) Notice: Subject to any disclaimer, the term of this patent is extended or adjusted under 35 U.S.C. 154(b) by 881 days.

(21) Appl. No.: 11/548,145

(22) Filed: Oct. 10, 2006

(65) Prior Publication Data

US 2008/0083784 A1 Apr. 10, 2008

(51) Int. Cl.
*B67B 1/00* (2006.01)

(52) U.S. Cl. ..... 222/153.13; 222/383.1

(58) Field of Classification Search ..... 222/153.13, 222/153.14, 321.1, 321.7, 321.8, 321.9, 190, 222/381.1, 385, 401
See application file for complete search history.

(56) References Cited

U.S. PATENT DOCUMENTS

| | | | | | |
|---|---|---|---|---|---|
| 4,057,176 | A | | 11/1977 | Horvath | |
| 4,433,799 | A | * | 2/1984 | Corsette | 222/309 |
| 4,458,832 | A | * | 7/1984 | Corsette | 222/153.13 |
| 4,496,082 | A | * | 1/1985 | Corsette | 222/153.13 |
| 4,615,467 | A | | 10/1986 | Grogan et al. | |
| 5,271,530 | A | | 12/1993 | Uehira et al. | |
| 5,401,148 | A | | 3/1995 | Foster et al. | |
| 5,443,569 | A | | 8/1995 | Uehira et al. | |
| 5,570,819 | A | | 11/1996 | Uehira et al. | |
| 5,615,806 | A | | 4/1997 | Grothoff | |
| 5,725,128 | A | | 3/1998 | Foster | |
| 5,738,250 | A | * | 4/1998 | Gillingham et al. | 222/153.13 |
| 6,006,949 | A | | 12/1999 | Foster et al. | |
| 6,045,008 | A | * | 4/2000 | Gonzalez Fernandez et al. | 222/153.13 |
| 6,053,371 | A | | 4/2000 | Durliat et al. | |
| 6,173,863 | B1 | | 1/2001 | Brozell et al. | |
| 6,334,549 | B1 | * | 1/2002 | Fernandez et al. | 222/153.13 |
| 6,533,144 | B2 | * | 3/2003 | Davies et al. | 222/153.13 |
| 6,644,516 | B1 | | 11/2003 | Foster et al. | |
| 6,840,408 | B1 | | 1/2005 | Foster et al. | |
| 6,923,346 | B2 | | 8/2005 | Foster et al. | |
| 2002/0070238 | A1 | | 6/2002 | Pritchett et al. | |
| 2004/0060945 | A1 | | 4/2004 | Carter et al. | |
| 2004/0069807 | A1 | | 4/2004 | Brouwer et al. | |

FOREIGN PATENT DOCUMENTS

| | | |
|---|---|---|
| GB | 910166 | 11/1962 |
| WO | 2005089953 | 9/2005 |

* cited by examiner

*Primary Examiner*—Lien T Ngo

(57) ABSTRACT

A manually operated, vertically reciprocating liquid pump dispenser is removably connectable to a bottle containing liquid and simultaneously pumps liquid from the bottle and air from the exterior environment of the dispenser and mixes the liquid with the air to produce a foam that is dispensed from the dispenser. The dispenser includes a closure connector and a rotatable collar on the connector that provides a mechanism for venting the interior of the bottle to the exterior environment of the dispenser while avoiding leakage of the liquid from the bottle, and also incorporate a mechanism for locking the dispenser to prevent unintended pumping of liquid from the bottle.

15 Claims, 5 Drawing Sheets

ROTATING COLLAR AND LOCKING AND VENTING CLOSURE CONNECTOR FOR AN AIR FOAMING PUMP DISPENSER

BACKGROUND OF THE INVENTION (1) Field of the Invention

The present invention pertains to a manually operated reciprocating liquid pump dispenser that is removably connectable to a bottle containing a liquid. Manual operation of the dispenser simultaneously pumps the liquid from the bottle and pumps air from the exterior environment of the dispenser, mixes the liquid with the air to produce a foam, and dispenses the foam from the dispenser. More specifically, the pump dispenser of the invention includes a closure connector and a rotatable collar on the connector that provide a mechanism for venting the interior of the bottle to the exterior environment of the pump dispenser while avoiding leakage of the liquid from the bottle, and also incorporate a mechanism for locking the pump dispenser to prevent unintended pumping of the liquid from the bottle.

(2) Description of the Related Art

Manually operated, vertically reciprocated pump dispensers are those types of dispensers that are typically oriented vertically in use, and have a plunger at the top of the dispenser that is manually pressed downwardly to dispense the liquid contents of a bottle connected to the dispenser. The typical construction of such a dispenser includes an elongate pump housing and an elongate plunger that is received inside the pump housing for reciprocating movements between charge and discharge positions of the pump plunger in the pump housing.

The pump housing is inserted into the bottle neck opening of the bottle. A closure connector at the top of the pump housing removably secures the pump housing to the bottle neck. A dip tube connected at the bottom of the pump housing extends downwardly into the liquid in the bottle. The pump housing contains a liquid pump chamber and a check valve. The check valve controls the flow of liquid through the dip tube and into the pump chamber, and prevents the reverse flow of liquid.

The pump plunger has a tubular length with a liquid discharge passage extending through the center of the plunger. A liquid piston is mounted on the plunger and is received in the pump chamber for reciprocating movements. A dispensing head is provided at the top of the plunger. The dispensing head has a discharge outlet that communicates with the discharge passage of the plunger. A check valve in the liquid discharge passage controls the flow of liquid from the pump chamber and out through the dispensing head, and prevents the reverse flow of liquid.

A spring is positioned in the pump chamber. The spring biases the plunger upwardly to a charge position of the plunger relative to the pump housing. The upward movement of the plunger moves the piston upwardly in the pump chamber, which creates a vacuum in the pump chamber that draws liquid through the dip tube and into the pump chamber.

The pump plunger is manually depressed downwardly against the bias of the spring to a discharge position of the plunger relative to the pump housing. The downward movement of the plunger moves the piston downwardly in the pump chamber. The downward piston movement forces the liquid in the pump chamber through the liquid discharge passage of the plunger and out of the dispenser through the dispensing head.

In addition to the basic component parts of the manually operated, vertically reciprocated pump dispenser described above, many prior art pump dispensers are provided with a venting feature. The venting feature includes a vent opening that communicates the exterior environment of the dispenser with the interior of the bottle when the pump plunger is reciprocated in the pump housing. Air from the exterior environment of the dispenser is allowed to pass through the vent opening and enter the bottle interior to fill the volume in the bottle interior left vacant by the liquid being dispensed by the operation of the pump. Without such a vent opening, as liquid is dispensed from the bottle, a vacuum would be created in the bottle interior. The vacuum would eventually overcome the vacuum created by the pump piston moving to its charge position in the pump chamber, and prevent the pump from drawing liquid into the pump chamber. The increasing vacuum in the interior of the bottle could also possibly result in the inwardly collapsing of the bottle side walls. To overcome this problem, many prior art manually operated, vertically reciprocated pump dispensers are provided with constructions that allow air to vent into the interior of the bottle connected to the dispenser, while preventing liquid in the bottle from leaking out of the dispenser through the vent feature.

In addition to the above, many prior art manually operated, vertically reciprocated pump dispensers are provided with a locking feature. The locking feature would lock the plunger in its upward charge position relative to the pump housing or its downward discharge position relative to the pump housing. The locking feature would also close the liquid flow path through the pump. The locking feature thus prevents the unintended pumping of liquid from the bottle caused by unintended reciprocating movements of the pump plunger in the pump housing.

All of the above-described features that are often included in the typical construction of a manually operated, vertically reciprocated pump dispenser add to the number of component parts of the dispenser and add to the complexity of the assembly of the dispenser.

Manually operated, vertically reciprocated liquid pump dispensers have been developed that not only pump liquid from a bottle through the dispenser, but also pump air from the exterior environment of the dispenser through the dispenser, mixing the air with the liquid to generate a foam that is dispensed from the dispenser. These types of dispensers not only include all of the component parts of a dispenser required to draw liquid from the bottle connected to the dispenser and pump the liquid from the dispenser, but also include the additional component parts required to draw air from the exterior environment of the dispenser into the dispenser, mix the air with the liquid being pumped through the dispenser to generate the foam, and dispense the foam from the dispenser. Dispensers of this type that pump both liquid and air have even more component parts and an even more complex assembly than dispensers that pump only liquid. To provide a dispenser of this type with a venting feature and a locking feature would even further increase the number of component parts and the complexity of the assembly of the dispenser. To manufacture such a dispenser economically, it is necessary to provide a unique design of the dispenser that reduces the number of separate component parts of the dispenser and simplifies the dispenser construction.

SUMMARY OF THE INVENTION

The manually operated, vertically reciprocating air foaming pump dispenser of the invention provides a unique dispenser construction that includes both liquid and air pumps and also provides a venting features and a locking feature while minimizing the number of component parts and the complexity of the dispenser assembly.

The construction of the pump dispenser of the invention is basically comprised of a pump housing that contains a liquid pump chamber, a closure connector that incorporates the venting feature and the locking feature with an air pump chamber of the dispenser, a pump plunger that is received in the pump housing for reciprocating movements and supports both a liquid pump piston and an air pump piston, a dispenser head that is mounted on the top of the pump plunger, and a collar mounted for rotation on the connector and operatively connected to the dispenser head where rotation of the collar locks the pump dispenser and seals the venting feature. All of the component parts of the dispenser are constructed of a plastic typically used in the construction of dispensers of this type, except for a coil spring and a pair of ball valves that could be constructed of metal or plastic. In the description of the pump dispenser provided herein, terms such as "upward" and "downward" are used to describe the dispenser in a vertically upright orientation shown in the drawing figures. This is the typical orientation of the dispenser when operated, but the dispenser could be operated in other orientations. Therefore, the terms "upward" and "downward," and related terms should not be interpreted as limiting.

The pump housing of the dispenser has a tubular configuration that contains the liquid pump chamber. A top opening in the pump housing provides access to the pump chamber. A flat, annular ring is provided around a top portion of the pump housing. The ring is dimensioned to rest on the top of the neck of the bottle to which the pump dispenser is attached. A vent hole passes through the ring and forms a portion of the vent passage to the bottle interior.

A dip tube extends downwardly from the bottom of the pump housing and communicates the dispenser with liquid in a bottle to which the dispenser is attached. A ball check valve is positioned in the pump housing between the dip tube and pump chamber. The ball valve controls the flow of liquid into the pump chamber, and prevents the reverse flow of liquid.

The closure connector is attached to the top of the pump housing. The connector has a flat, circular base that extends over the top of the pump housing annular ring. A center hole through the base aligns with the top opening of the pump housing. A cylindrical side wall extends downwardly from the outer periphery of the base. The side wall has internal screw threading, a bayonet fitment, or other equivalent means of removably attaching the connector to the neck of the bottle, and thereby removably attaching the dispenser to the bottle. A cylindrical air pump chamber wall extends upwardly from the connector base. A vent opening passes through the connector base below the air pump chamber wall. The vent opening through the connector base communicates with the hole through the pump housing annular ring. Thus, an air venting passage is provided from the exterior environment of the pump dispenser through the vent opening in the connector base, and through the hole in the pump housing annular ring to the interior of the bottle connected to the pump dispenser. A plurality of lock columns are provided on the closure connector on the exterior of the air pump chamber wall. The plurality of columns project upwardly from the connector base and have connector lock surfaces at the upper distal ends of the columns.

The pump plunger has a tubular length that extends downwardly through the center hole of the connector base and through the top opening of the pump housing. A liquid discharge passage of the pump dispenser extends through the center of the plunger. The pump plunger is received in the pump housing for reciprocating movements of the pump plunger in the pump housing. The pump plunger is moved downwardly through the pump housing to a discharge position of the pump plunger relative to the pump housing, and is moved upwardly through the pump housing to a charge position of the pump plunger relative to the pump housing.

A ball check valve is positioned in the liquid discharge passage adjacent the top of the plunger. The ball valve controls the flow of liquid from the pump chamber through the plunger, and prevent the reverse flow of liquid.

A liquid piston is mounted to the lower end of the plunger. The liquid piston engages in a sealed, sliding engagement in the liquid pump chamber of the pump housing.

An air piston is also mounted on the plunger above the liquid piston. The air piston engages in a sealed, sliding engagement in the air pump chamber on the closure connector.

A dispenser head is mounted on the top of the pump plunger. The dispenser head contains a spout having an outlet passage that communicates with the liquid discharge passage of the plunger. A cylindrical sleeve of the pump dispenser extends downwardly from the spout. The sleeve is coaxial with the pump plunger and extends around the exterior of the closure connector air pump chamber wall. The dispenser head has a plurality of pairs of posts that extend downwardly in the interior of the dispenser sleeve. Each pair of posts has an axial groove at the center of the pair of posts. The bottom distal ends of the posts have lock surfaces of the dispenser head.

A cylindrical collar is mounted on the closure connector for rotation of the collar relative to the connector. The collar has an interior surface with a plurality of narrow ridges or tongues extending axially across the interior surface. The plurality of tongues are spacially arranged around the collar interior surface and engage in sliding contact in the grooves between the pairs of posts on the dispenser head. In this manner the dispenser head is operatively connected to the collar for rotation of the dispenser head together with the collar around the center axis of the pump dispenser, and for axial reciprocating movement of the dispenser head relative to the collar. The exterior dimension of the collar is slightly smaller than the interior dimension of the dispenser head sleeve, whereby the dispenser head sleeve telescopes over the collar when the dispenser head is reciprocated axially relative to the collar. The collar also has a plurality of tabs spacially arranged around the interior of the collar. Each of the tabs has a sealing surface positioned to cover over and close one of the plurality of vent openings of the closure connector. The collar is mounted on the closure connector for rotation between a closed position of the collar on the connector where the collar sealing surfaces engage over and close the connector vent openings, and an opened position of the collar on the connector where the collar sealing surfaces are displaced from the connector vent openings and the bottle interior communicates through the connector vent openings with the exterior environment of the pump dispenser.

The operative connection between the collar and the dispenser head also causes the dispenser head to rotate on the pump dispenser when the collar is rotated on the pump dispenser. The dispenser head rotates with the collar between a locked position and an unlocked position of the dispenser head relative to the closure connector that correspond respectively to the closed and opened positions of the collar. In the locked position of the dispenser head and the closed position of the collar, the lock surfaces at the distal ends of the dispenser head posts are axially aligned opposite the lock surfaces at the ends of the connector columns. The axial alignment of the dispenser head lock surfaces and the connector lock surfaces prevents the dispenser head from being reciprocated relative to the collar, and thereby prevents the pump plunger from being reciprocated in the pump housing. Thus, the collar and closure connector of the invention close the air venting passageway through the pump dispenser and lock the pump plunger in the first, charge position of the pump plunger relative to the pump housing when the collar and dispenser head are rotated together to the vent closed position of the collar and the locked position of the dispenser head.

Rotating the collar away from the closed position toward the opened position of the collar relative to the pump dispenser causes the collar sealing surfaces to move away from the connector vent openings, thereby opening communication between the bottle interior and the exterior environment of the pump dispenser. Simultaneously, the dispenser head rotates relative to the closure connector and the dispenser head lock surfaces move away from their axially aligned positions opposite the connector lock surfaces. With the dispenser lock surfaces axially misaligned from the connector lock surfaces, the dispenser head is free to be reciprocated relative to the collar and the closure connector, thereby allowing reciprocating movements of the pump plunger in the pump housing.

Thus, the pump dispenser of the invention comprises both a liquid pump and an air pump that mix liquid and air pumped through the dispenser to create a foam dispensed by the dispenser. In addition, the novel construction of the pump dispenser provides a collar and dispenser head that are rotatable together relative to a closure connector of the pump dispenser to provide a venting feature and a lock feature of the dispenser, thereby reducing the number of component parts of the dispenser and simplifying the dispenser construction.

DESCRIPTION OF THE DRAWING FIGURES

Further features of the air foaming pump dispenser of the invention are set forth in the following detailed description of the pump dispenser and in the drawing figures of the pump dispenser.

DETAILED DESCRIPTION OF THE PREFERRED EMBODIMENT

Figure 1:
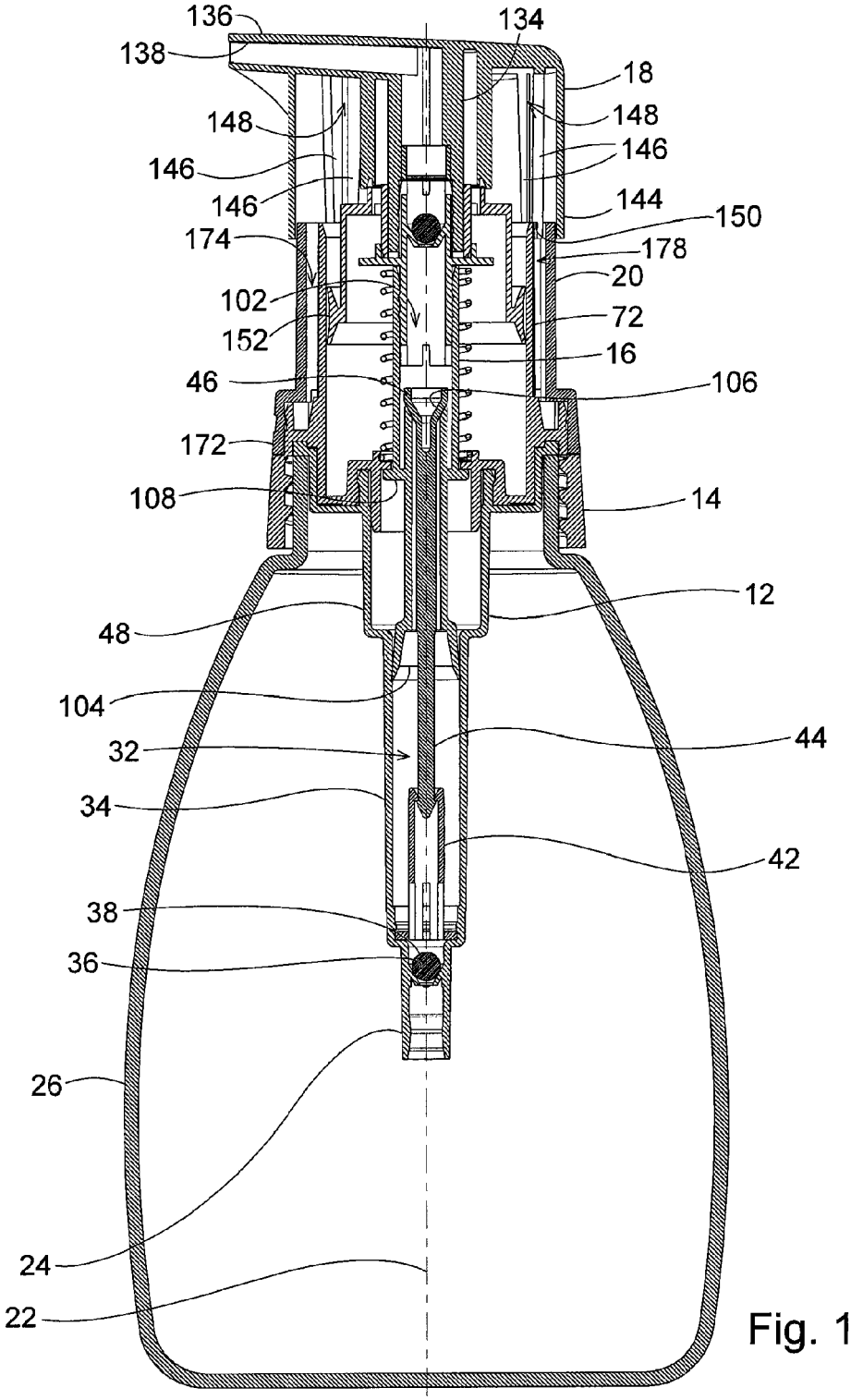
FIG. 1 is a side-sectioned view of the air foaming pump dispenser connected to a bottle and with the pump plunger in the upward, charge position of the pump plunger relative to the pump housing.

The basic component parts of the pump dispenser that comprise the novel features of the invention are the pump housing 12, the closure connector 14, the pump plunger 16, the dispenser head 18 and a locking and venting collar 20. These five basic component parts, as well as most of the other component parts of the dispenser to be described, are constructed of a plastic material typically used in the construction of pump dispensers of this type. The exceptions are the coil spring of the dispenser and a pair of ball valves of the dispenser, which could be constructed of plastic, but are usually constructed of metal.

Figure 2:
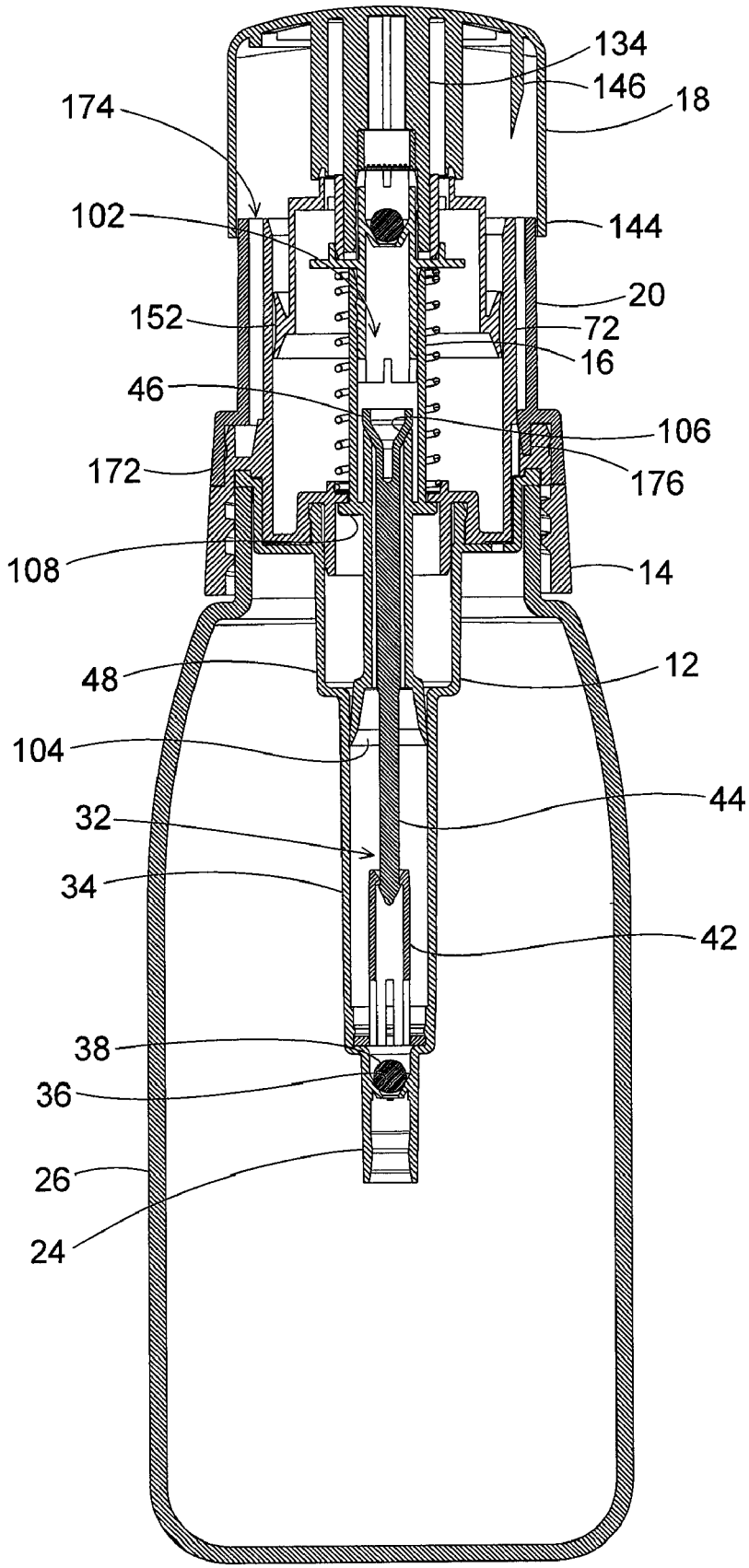
FIG. 2 is a front-sectioned view of the air foaming pump dispenser of FIG. 1.
Figure 3:
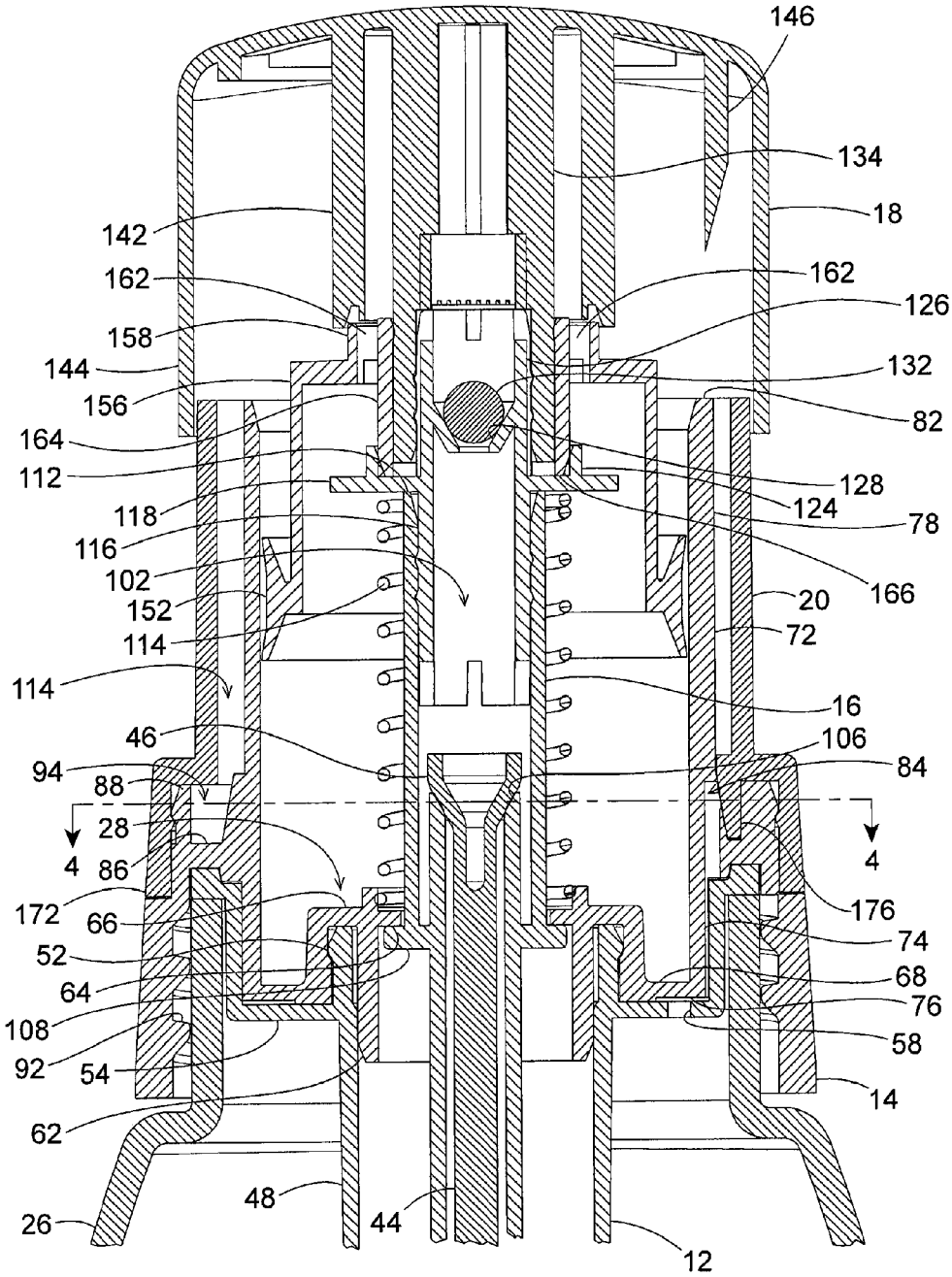
FIG. 3 is an enlarged partial view of the pump dispenser shown in FIG. 2.

The pump housing 12 has a tubular length with a hollow center bore having a center axis 22. The length of the pump housing 12 extends from a dip tube connector 24 at the bottom of the pump housing to an opposite top end 28 of the pump housing that surrounds a top opening into the pump housing. The dip tube connector 24 connects to a dip tube (not shown) that extends into the interior of a bottle 26. The pump housing 12 contains a liquid pump chamber 32 having a cylindrical liquid pump chamber wall 34. A valve seat 36 is provided at the bottom of the pump housing 12 between the dip tube connector 24 and the liquid pump chamber 32. The valve seat 36 supports a ball valve 38. The ball valve 38 controls the flow of liquid through the dip tube and the dip tube connector 24 into the liquid pump chamber 32, and prevents the reverse flow of liquid. A sealing plug retainer 44 extends axially upwardly from the bottom of the liquid pump chamber 32. The sealing plug retainer 42 retains an elongate stem 44 of a sealing plug 46 in the pump housing 12. The engagement of the retainer 42 with the stem 44 allows for some limited axial movement of the sealing plug 46 in the pump housing 12. A radially enlarged portion 48 of the pump housing 12 extends axially upwardly from the liquid pump chamber wall 34. This portion 48 of the housing extends upwardly to the top end 28 of the pump housing surrounding the top opening. An annular lip 52 is formed on the exterior surface of the pump housing 12 around the top opening. Spaced below the annular lip 52 is a flat annular ring 54 that projects radially outwardly from the pump housing 12. A vent hole 58 (shown in FIG. 2) passes through the annular ring 54 and functions as a portion of the air vent path.

The closure connector 14 has a general cylindrical configuration that is coaxial with the pump housing 12. A center tubular stem 62 of the connector 14 is inserted into the opening at the pump housing top end 28. A circular rim 64 projects inwardly from the interior of the stem 62. An annular shoulder 66 of the connector extends over the pump housing top 28 and downwardly over the pump housing annular lip 52 securing the closure connector 14 to the pump housing 12. A flat circular base 68 extends radially outwardly from the closure connector shoulder 66. A cylindrical wall 72 extends upwardly from the outer peripheral edge of the connector base 68. The wall 72 forms an air pump chamber wall that surrounds the air pump chamber of the dispenser. An axial groove 74 is formed in the exterior surface of a lower portion of the air pump chamber wall 72. The axial groove 74 intersects an annular trough 76 formed into the bottom surface of the connector base 68. The trough 74 extends radially inwardly from the outer peripheral edge of the connector base 68 to a position over the vent hole 58 in the pump housing annular ring 54. Thus, the groove 74 in the air pump chamber wall 72 and the trough 76 in the bottom of the closure connector base 68 form a portion of the air venting flow path through the pump dispenser.

Figure 5:
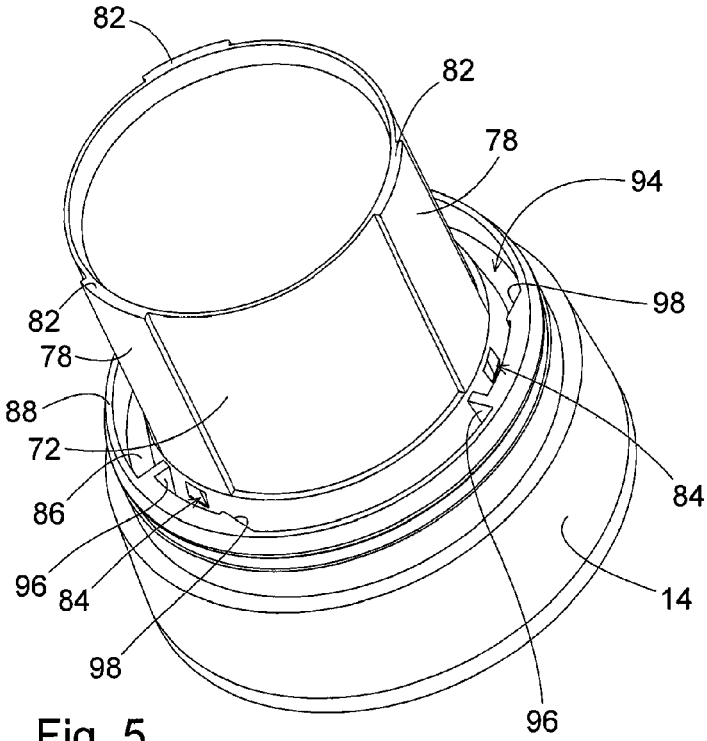
FIG. 5 is a top perspective view of the closure connector removed from the pump dispenser.
Figure 6:
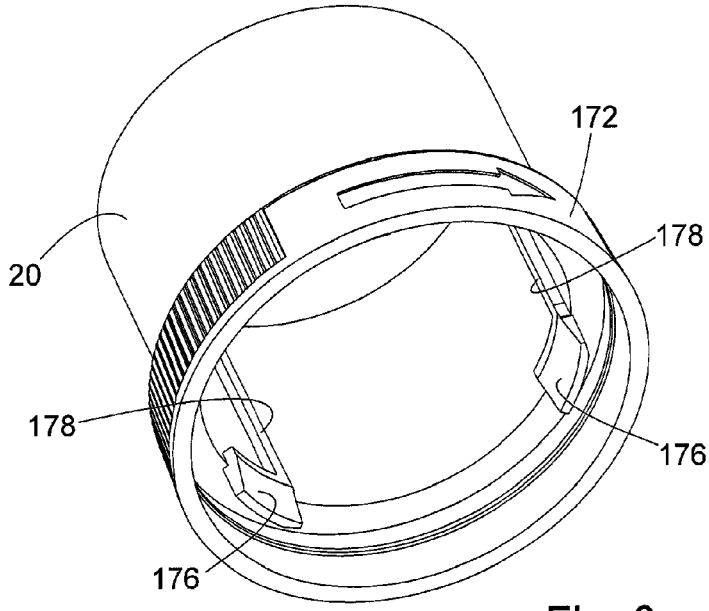
FIG. 6 is a bottom perspective view of the collar removed from the pump dispenser.

Portions of the air pump chamber wall 72 are thicker than the remainder of the wall. These portions form lock columns 78 that extend axially upwardly over the exterior surface of the air pump chamber wall 72. FIG. 5 shows three lock columns 78 on the exterior surface of the air pump chamber wall. In the embodiment shown, there are three lock columns 78 spacially arranged around the air pump chamber wall 72. Each lock column 78 extends axially upwardly to the top edge of the air pump chamber wall 72 where a lock surface 82 is provided on the top distal end of each lock column 78.

Positioned adjacent the bottom of each lock column 78 is a vent opening 84 into the air pump chamber wall 72. Each vent opening 84 communicates with one of the axial grooves 74 formed in the exterior surface of the air pump chamber wall 72. In the embodiment of the pump dispenser shown in the drawing figures, there are three such vent openings 84 spacially arranged around the air pump chamber wall 72. Together the vent openings 84, the axial grooves 74, and the radial trough 76 form a vent air flow path from the exterior of the air pump chamber wall 72 through the pump dispenser to the interior of the bottle 26 connected to the pump dispenser.

Figure 4:
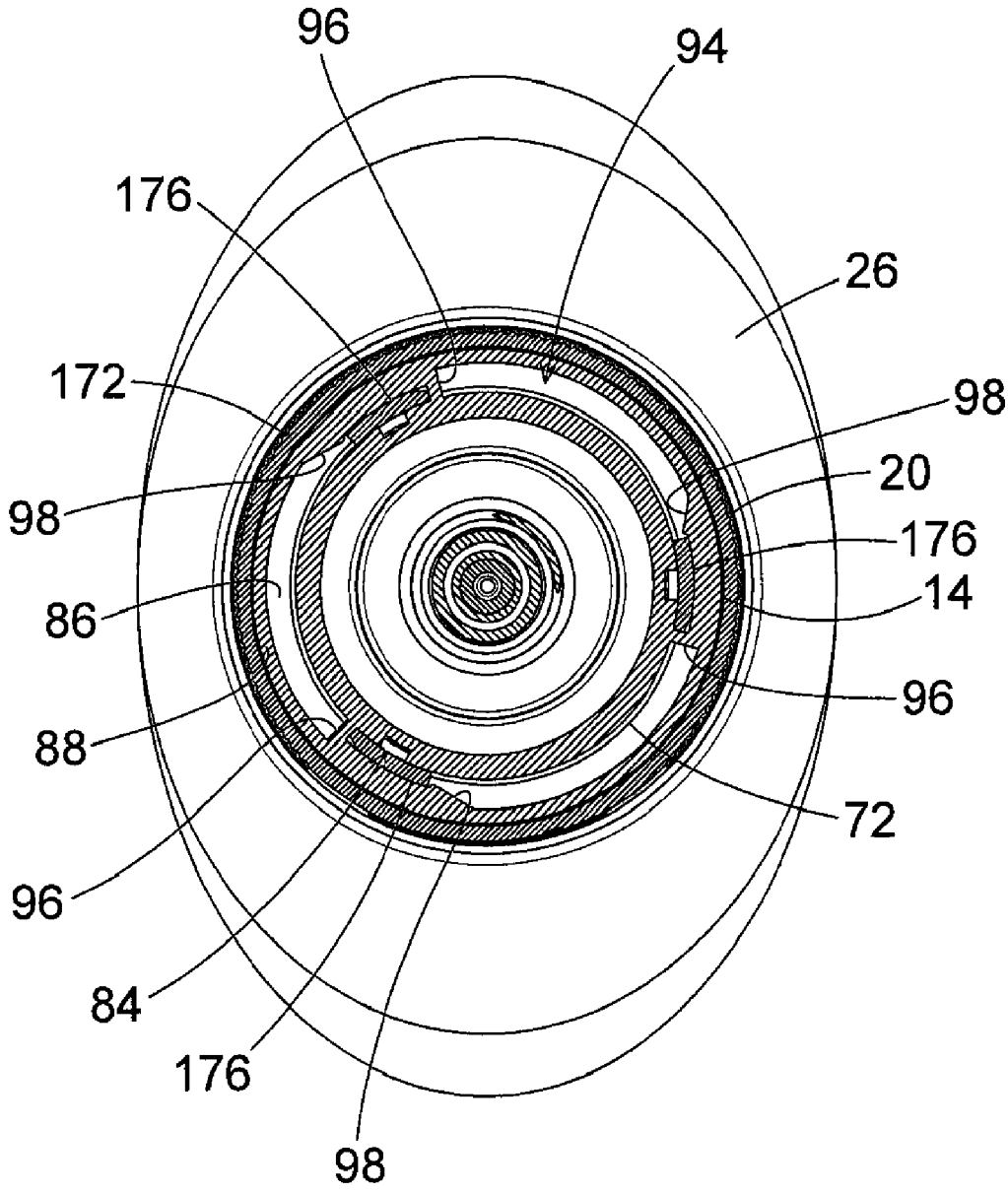
FIG. 4 is a top-sectioned view of the air foaming pump dispenser along the line 4-4 of FIG. 3.

An annular flange 86 projects radially outwardly from the air pump chamber wall 72 just below the plurality of vent openings 84. The flange 86 extends outwardly to an outer peripheral edge of the flange that joins with a cylindrical side wall 88 of the closure connector. A portion of the side wall 88 extends axially downwardly from the outer peripheral edge of the annular flange 86. This lower portion of the side wall 88 has internal screw threading 92 that is used to removably attach the pump dispenser to the neck of the bottle 26. Other equivalent connectors, for example a bayonet connector, could be used. A cylindrical upper portion of the side wall 88 extends axially upwardly from the outer peripheral edge of the annular flange 86. The annular flange 86 spaces the upper portion of the side wall 88 radially outwardly from the air pump chamber wall 74 and forms an annular groove 94 between the upper portion of the connector side wall 88 and the air pump chamber wall 72. As seen in the drawing figures and in particular in FIG. 5, each of the vent openings 84 open through the air pump chamber wall 72 in the annular groove 94. Referring to FIGS. 4 and 5, three stop surfaces 96 extend across the annular groove 94 adjacent the three vent openings 84. Three tab locks 98 project into the annular groove 94 on the opposite sides of the vent openings 84 from the lock surfaces.

The pump plunger 16 is mounted in the interior of the pump housing 12 for reciprocating movements between an upward, first charge position of the pump plunger 16 relative to the pump housing 12, and a downward second discharge position of the pump plunger 16 relative to the pump housing 12. The pump plunger 16 is also rotatable in the pump housing 12. The pump plunger 16 has an elongate tubular length with a center bore 102 that is coaxial with the center axis 22 of the pump housing. The plunger center bore 102 forms a liquid discharge passage through the pump plunger. A liquid piston 104 is formed at the bottom end of the pump plunger 16. The liquid piston 104 engages in a sliding sealing engagement with the liquid pump chamber wall 34. A sealing plug seat 106 is formed on an intermediate portion of the pump plunger 16. The sealing plug seat 106 is positioned to engage in a sealing engagement with the sealing plug 46 when the pump plunger 16 is moved to its upward, charge position relative to the pump housing 12. An annular retainer ring 108 extends radially outwardly from the pump plunger 16 just below the sealing ring 106 and below the interior rim 64 of the closure connector 14. The engagement of the pump plunger retainer ring 108 with the closure connector rim 64 prevents the pump plunger 16 from being removed from the pump housing 12, and positions the pump plunger 16 in the charge position relative to the pump housing 12. From the retainer ring 108, the pump plunger 16 extends axially upwardly to a top end 112 of the plunger that surrounds a top opening of the plunger.

A coil spring 114 is positioned over the pump plunger 16 and engages on top of the closure connector interior rim 64. The spring 114 biases the pump plunger 16 toward its upward, first charge position relative to the pump housing 12.

A tubular spring holder 116 is inserted into the top end 112 of the pump plunger 12 and is held firmly in the plunger. The spring holder 116 has an annular ring 118 that projects radially outwardly from the spring holder 116 and engages against the top end 112 of the plunger and the top of the coil spring 114. The coil spring 114 acts against the spring holder ring 118 in biasing the pump plunger 16 upwardly to the first, charge position of the plunger 16 relative to the pump housing 12. An air seal ring 124 projects axially upwardly from the top of the spring holder ring 118. Radially inside the air seal ring 124, a plurality of air path grooves 126 are formed in the exterior surface of the spring holder 116. The grooves 126 extend axially upwardly from the annular ring 118 to the top end of the spring holder 116. A valve seat 128 is provided inside the tubular spring holder 116 adjacent the top end of the spring holder. A ball valve 132 is positioned on the valve seat 128. The ball valve 132 controls the flow of fluid upwardly through the spring holder 116 as part of the liquid discharge passage 102 of the pump plunger, and prevents the reverse flow of liquid.

The dispenser head 18 is mounted on the pump plunger 16 by being mounted onto the top end of the spring holder 116. The dispenser head 18 has a center tube 134 inside the dispenser head that is press fit over the top end of the spring holder 116. The engagement of the dispenser head center tube 134 with the spring holder 116 securely holds the dispenser head to the pump plunger 16. The air path grooves 126 in the spring holder 116 provide an air path between the spring holder 116 and the dispenser head center tube 134. A discharge nozzle 136 projects radially outwardly from the dispenser head center tube 134, and an outlet passage 138 in the discharge nozzle 136 communicates with the interior of the center tube 134 and forms a portion of the discharge passage of the pump dispenser. A circular air seal rim 142 is formed in an interior surface of the dispenser head 18 and extends around the dispenser head center tube 134. A cylindrical sleeve 144 extends axially downwardly from the dispenser head 18 and is spaced radially outwardly from the center tube 134 and the air seal rim 142.

Pairs of posts 146 extend downwardly in the interior of the dispenser head 18. In the illustrated embodiment of the pump dispenser, there are three pairs of posts 146 spacially arranged around the pump dispenser center axis 22 inside the dispenser head 18. Each of the pairs of posts 146 are spaced radially inwardly from the dispenser head sleeve 144. An axial groove 148 is formed between each of the pairs of posts 146. Each of the grooves 148 extends axially downwardly for the entire length of its associated pair of posts 146. Each of the pairs of posts 146 also has radial lock surfaces 150 formed at the bottom ends of the posts. These lock surfaces 150 of the dispenser head 18 are positioned adjacent the top end of the air pump chamber wall 72 on the closure connector 14. With the dispenser head 18 being rotatable with the pump plunger 16 relative to the connector closure 14 and the pump housing 12, in a first rotated position of the dispenser head 18 relative to the connector 14, the dispenser head lock surfaces 150 are axially aligned opposite the lock surfaces 82 at the tops of the lock columns 78 on the air pump chamber wall 72. Rotating the dispenser head 18 and the pump plunger 16 relative to the closure connector 14 and the pump housing 12 to a second, unlocked position of the dispenser head 18 relative to the closure connector 14 axially misaligns the dispenser head lock surfaces 150 and the closure connector lock surfaces 82. When rotated to the first, locked position, the dispenser head lock surfaces 150 are axially aligned opposite the closure connector lock surfaces 78 and the opposed lock surfaces will engage with each other when the dispenser head 18 is manually pressed downwardly. The engagement of the dispenser head lock surfaces 150 with the closure connector lock surfaces 82 prevents the pump plunger 16 from being reciprocated relative to the pump housing 12 when the dispenser head 18 is manually pressed toward the pump housing. To unlock the pump plunger 16, the plunger 16 and the dispenser head 18 are rotated relative to the pump housing 12 and the closure connector 14 to the second, unlocked position of the dispenser head 18 relative to the closure connector 14. In the unlocked position the dispenser head lock surfaces 150 are misaligned with the closure connector lock surfaces 82, and the pump plunger 16 can be manually pressed downwardly into the pump housing 12 by manually pressing the dispenser head 18 downwardly. This allows the pump plunger 16 to be reciprocated in the pump housing 12.

An air pump piston 152 is mounted on the pump plunger 16 and engages in a sliding sealing engagement in the air pump chamber wall 72. The air piston 152 has a cylindrical center portion 156 that extends from the outer sealing portion of the air piston 152 axially upwardly and then radially inwardly toward the pump plunger 16. A cylindrical upper end 158 of the air piston cylindrical portion 156 is dimensioned to engage in a sealing engagement in the air seal rim 142 of the dispenser head 18. The air piston upper end 158 is joined by a plurality of radial spokes 162 to a center tubular column 164 of the air piston. The spacings between the radial spokes 162 provide air flow paths between the air piston upper end 158 and the air piston center column 164. The air piston column 164 is mounted for limited axial sliding movement on the dispenser head center tube 134. When the air piston column 164 moves downwardly relative to the dispenser head center tube 134, a bottom annular edge 166 of the column engages in a sealing engagement inside the spring holder air seal ring 124. This closes an air flow path from the interior of the air pump chamber inside the air pump chamber wall 72 through the air path grooves 126 between the spring holder 116 and the dispenser head center tube 134 to the dispenser head outlet passage 138. The downward movement of the air piston 152 on the dispenser head center tube 134 causes the upper end 158 of the air piston to disengage from the air seal rim 142 of the dispenser head. This opens an air flow path from the exterior of the dispenser head through the spacing between the dispenser head sealing rim 142 and the air piston upper end 158 allowing air from the exterior environment of the dispenser pump to enter the air pump chamber inside the air pump chamber wall 72.

The cylindrical locking and venting collar 20 is mounted on the closure connector 14 for rotation of the collar on the connector. The collar 20 has a lower cylindrical rim portion 172 that snaps over the upper portion of the connector side wall 88 in mounting the collar 20 on the connector 14 for rotation. From the rim 172, the collar 20 extends axially upwardly over the exterior surface of the connector air pump chamber wall 72. A radial spacing 174 is left between the collar 20 and the air pump chamber wall 72. This radial spacing 174 forms a portion of the air vent flow path through the pump dispenser.

A plurality of sealing tabs 176 are spaced radially inwardly from the collar rim 172 and extend axially downwardly from the collar 20 into the annular groove 94 of the closure connector. A narrow tongue or ridge 178 extends axially upwardly from each sealing tab 176 across the interior surface of the collar 20. The collar tongues 178 engage in sliding engagement in the grooves 148 between the dispenser head posts 146 in operatively connecting the collar 20 to the dispenser head 18. The connection between the collar 20 and the dispenser head 18 provided by the sliding engagement of the collar tongues 178 in the dispenser head grooves 148 allows the dispenser head 18 to be reciprocated axially relative to the collar 20, and connects the collar 20 to the dispenser head 18 for rotation with the dispenser head.

The collar 20 is rotatable between a locked, vent closed position and an unlocked, vent opened positioned of the collar 20 relative to the closure connector 14. In the locked, vent closed position, the collar 20 is rotated in a clockwise direction when looking at the top of the pump dispenser. The collar 20 is rotated to where each of the collar sealing tabs 176 engages against a stop surface 96 in the annular groove 94 of the closure connector 14. This positions a surface of each sealing tab 176 over each vent opening 84 of the closure connector, closing the air vent passage through the pump dispenser. The engagement of the closure connector tab locks 98 on the opposite sides of the collar tabs 176 from the connector stop surfaces 96 securely holds the collar 20 in the locked, vent closed position relative to the connector 14. In this position also, the operative connection between the collar 20 and the dispenser head 18 provided by the engagement of the collar tongues 178 in the dispenser head grooves 148 positions the dispenser head 18 relative to the connector air pump chamber wall 72 where the dispenser head lock surfaces 150 are aligned axially opposite the connector lock surfaces 82. This prevents the dispenser head 18 from being reciprocated relative to the closure connector 14, and thereby prevents reciprocating movements of the pump plunger 16 in the pump housing 12.

Rotating the locking/venting collar 20 counterclockwise relative to the closure connector 14 moves the collar 20 from the locked, vent closed position to an unlocked, vent opened position of the collar. This rotation of the collar 20 requires sufficient manual force to disengage each of the collar sealing tabs 176 form its engaging tab lock 98 of the closure connector 14. As each sealing tab 176 is moved over its engaging tab lock 98, the surface of the sealing tab 176 closing over the vent opening 84 of the closure connector 14 is moved away from the vent opening. This opens an air vent path from the exterior of the pump dispenser through the radial spacing 174 between the collar 20 and the closure connector air pump chamber wall 72, through the connector vent openings 84, through the axial grooves 74 in the air pump chamber wall 72 and the annular trough 76 on the bottom of the connector base 68 and through the vent hole 58 in the pump dispenser annular ring 54 to the interior of the bottle 26. This rotation of the collar 20 also causes the dispenser head 18 to rotate relative to the closure connector 66 due to the operative engagement between the collar tongues 178 in the dispenser head grooves 148. The movement of the dispenser head 18 relative to the connector closure 14 moves the dispenser head lock surfaces 150 away from axial alignment with the closure connector lock surfaces 82. This allows the dispenser head 18 to be reciprocated over the collar 20, and thereby allows the pump plunger 16 to be reciprocated in the pump housing 12.

As the pump plunger 16 is moved downwardly into the pump housing 12, an air flow path is established through the spacing between the dispenser head air seal rim 142 and the air pump piston upper end 158 providing air into the air pump chamber surrounded by the air pump chamber wall 72. This air flow path exists for the short period of time before the air piston 152 moves upwardly relative to the dispenser head center tube 134 and the air piston upper end 158 engages in a sealing engagement with the dispenser head air seal rim 142. Simultaneously, the bottom edge 166 of the air pump piston tubular column 164 disengages from the air seal ring 124 of the spring holder 116. This opens an air flow path from the air pump chamber through the grooves 126 in the spring holder 116 to the dispenser head outlet passage 134. Further downward movement of the pump plunger 16 into the pump housing 12 causes downward movement of the air piston 152 in the air pump chamber surrounded by the air pump chamber wall 72, which causes air to be forced from the air pump chamber through the spring holder grooves 126 to the dispenser head outlet passage 138.

Additionally, as the pump plunger 16 moves downward through the pump housing 12, liquid in the liquid pump chamber 32 is pumped out of the chamber by the downward movement of the liquid piston 104 through the liquid pump chamber. The liquid is forced upwardly through the pump plunger liquid discharge passage 102 and mixes with the air pumped from the air pump chamber, generating a foam. The foam is dispensed through the dispenser head outlet passage 138 from the dispenser.

After the pump plunger 16 has been moved downwardly to its second, discharge position relative to the pump housing 12, the manual pressure on the pump plunger 16 is removed and the coil spring 114 pushes the pump plunger 16 upwardly in the pump housing 12. The spring pushes the plunger 16 upwardly in the housing 12 to the first, charge position of the pump plunger 16 relative to the pump housing 12. This causes the liquid piston 104 to move upwardly through the liquid pump chamber 32 drawing liquid into the liquid pump chamber, and causes the air piston 152 to first be stationary as the plunger moves upwardly and the dispenser head air seal rim 142 disengages from the air piston upper end 158, and then moves upwardly with the plunger through the air pump chamber surrounded by the air pump chamber wall 72 drawing air into the air pump chamber. With the pump plunger 16 in its first, charge position relative to the pump housing 12, the plunger is ready for additional manual reciprocating movements relative to the pump housing 12, or is in position to be rotated clockwise relative to the pump housing 12 back to the lock position of the plunger 16.

As described above, the pump dispenser of the invention comprises both a liquid pump and an air pump that mix liquid and air pumped through the dispenser to create a foam dispensed by the dispenser. In addition, the novel construction of the pump dispenser incorporates a collar rotatably mounted on the closure connector with a venting feature and a lock feature of the dispenser, thereby reducing the number of component parts of the dispenser and simplifying the dispenser construction.

Although the air foaming pump dispenser of the invention has been described above by reference to a specific embodiment shown in the drawing figures, it should be understood that modifications and variations could be made to the air foaming pump dispenser without departing from the intended scope of the following claims.

The invention claimed is:

1. A pump dispenser that is connectable to a bottle and is manually operated to pump liquid from the bottle interior, pump dispenser comprising:

a pump plunger having a tubular length with a center axis that defines mutually perpendicular axial and radial directions relative to the pump dispenser, the pump plunger having a discharge passage extending axially through the pump plunger;

at least one piston on the pump plunger;

a pump housing that receives the pump plunger for axially reciprocating movements of the pump plunger between a first, charge position and a second, discharge position of the pump plunger relative to the pump housing;

an air vent passage through the pump dispenser that provides communication between the bottle interior and an exterior environment of the pump dispenser when the pump dispenser is connected to the bottle;

a cylindrical collar mounted on the pump dispenser for manual rotational movement of the collar around the pump dispenser between a vent closed position of the collar on the pump dispenser where the collar closes the air vent passage through the pump dispenser and a vent opened positioned of the collar on the pump dispenser where the collar opens the air vent passage through the pump dispenser;

a dispenser head on the pump plunger, the dispenser head having an outlet passage that communicates with the pump plunger discharge passage and extends radially from the discharge passage, the dispenser head moving with the pump plunger between the first, charge position and the second, discharge position of the pump plunger relative to the pump housing, and the dispenser head having a lock that prevents the dispenser head from moving with the pump plunger between the first, charge position and the second, discharge position of the pump plunger when the collar is in the closed position, and allows the dispenser head to move with the pump plunger between the first, charge position and the second, discharge position of the pump plunger when the collar is in the opened position.

2. The pump dispenser of claim 1, further comprising:

the dispenser head being operatively connected to the collar to move in rotation with the collar and to move axially relative to the collar.

3. The pump dispenser of claim 1, further comprising:

a cylindrical connector on the pump housing, the connector being removably connectable to the bottle to connect the pump dispenser to the bottle, the connector having a vent opening that forms a portion of the air vent passage through the pump dispenser; and, the collar being mounted for rotation on the connector, the collar having a sealing surface that covers over and closes the connector vent opening when the collar is in the closed position and is displaced from and opens the connector vent opening when the collar is in the opened position.

4. The dispenser of claim 3, further comprising:

a lock surface on the connector that is axially spaced from the connector vent opening; and, the dispenser head lock having a lock surface, the dispenser head being operatively connected to the collar to move in rotation with the collar and to move axially relative to the collar when the dispenser head moves with the pump plunger between the first, charge position and the second, discharge position of the pump plunger relative to the pump housing, the dispenser head lock surface being axially aligned with the connector lock surface when the connector is in the closed position and the pump plunger is in the first, charge position, the dispenser head lock surface being axially aligned with the connector lock surface preventing the dispenser head and the pump plunger for moving between the first, charge position and the second, discharge position of the pump plunger relative to the pump housing, and the dispenser head lock surface being axially misaligned with the connector lock surface when the connector is in the opened position, the dispenser head lock surface being axially misaligned with the connector lock surface allowing the dispenser head to move with the pump plunger between the first, charge position and the second, discharge position of the pump plunger relative to the pump housing.

5. The pump dispenser of claim 4, further comprising:

a stop surface on the connector; and, a stop surface on the collar, the collar stop surface being positioned on the collar to engage with the connector stop surface and prevent further rotation of the collar on the connector when the collar is rotated from the opened position of the collar to the closed position of the collar where the engagement of the collar stop surface with the connector stop surface positively locates the collar sealing surface over the connector vent opening.

6. The pump dispenser of claim 4, further comprising:

the dispenser head being operatively connected to the collar by a tongue and groove connection between the dispenser head and the collar.

7. A pump dispenser that is connectable to a bottle and is manually operated to pump liquid from the bottle interior, the pump dispenser comprising:

a pump plunger having a tubular length with a center axis that defines mutually perpendicular axial and radial directions relative to the pump dispenser, the pump plunger having a discharge passage that extends axially through the pump plunger;

at least one piston on the pump plunger;

a pump housing that receives the pump plunger for rotation of the pump plunger in the pump housing and for axially reciprocating movements of the pump plunger between a first, charge position of the pump plunger relative to the pump housing and a second, discharge position of the pump plunger relative to the pump housing;

an air vent passage through the pump dispenser that provides communication between the bottle interior and an exterior environment of the pump dispenser when the pump dispenser is connected to the bottle;

a cylindrical connector on the pump housing, the connector being removably connectable to the bottle to connect the pump dispenser to the bottle, the connector having a lock surface on the connector, the connector having a connector wall that extends axially from the pump housing over the pump plunger to a distal end of the wall, and the connector lock surface being on the distal end of the connector wall, the connector wall being a cylindrical pump chamber wall that extends axially from the pump housing and extends around the pump plunger, the connector having a vent opening that forms a portion of the air vent passage through the pump dispenser;

a cylindrical collar mounted on the connector for rotation of the collar around the connector, the collar having a sealing surface that covers over and closes the connector vent opening when the collar is rotated with the dispenser head to the locked position of the dispenser head relative to the connector, and is displaced from and opens the connector vent opening when the collar is rotated with the dispenser head to the unlocked position of the dispenser head relative to the connector; and a dispenser head on the pump plunger, the dispenser head being operatively connected to the collar to move in rotation with the collar and to move axially relative to the collar and the dispenser head having an outlet passage that communicates with the pump plunger discharge passage and extends radially from the discharge passage, the dispenser head moving with the pump plunger between the first, charge position and the second, discharge position of the pump plunger relative to the pump housing, the dispenser head having a lock surface on the dispenser head, and the dispenser head in the first, charge position being rotatable relative to the connector and the connector lock surface between a locked position of the dispenser head relative to the connector where the dispenser head lock surface is axially aligned with the connector lock surface and prevents the dispenser head and the pump plunger from moving between the first, charge position and the second, discharge position of the pump plunger relative to the pump housing, and an unlocked position of the dispenser head relative to the connector where the dispenser head lock surface is axially misaligned with the connector lock surface and allows the dispenser head and the pump plunger to move between the first, charge position and the second, discharge position of the pump plunger relative to the pump housing.

8. The pump dispenser of claim 7, further comprising:

a stop surface on the connector; and, a stop surface on the collar, the collar stop surface being positioned on the collar to engage with the connector stop surface and prevent further rotation of the collar on the connector when the collar is rotated with the dispenser head to the locked position of the dispenser head relative to the connector where the engagement of the collar stop surface with the connector stop surface positively locates the collar sealing surface over the connector vent opening.

9. A pump dispenser that is connectable to a bottle and is manually operated to pump liquid from the bottle interior, the pump dispenser comprising:

a pump plunger having a tubular length with a center axis that defines mutually perpendicular axial and radial directions relative to the pump dispenser, the pump plunger having a discharge passage that extends axially through the pump plunger;

at least one piston on the pump plunger;

a pump housing that receives the pump plunger for rotation of the pump plunger in the pump housing and for axially reciprocating movements of the pump plunger between a first, charge position of the pump plunger relative to the pump housing and a second, discharge position of the pump plunger relative to the pump housing;

an air vent passage through the pump dispenser that provides communication between the bottle interior and an exterior environment of the pump dispenser when the pump dispenser is connected to the bottle;

a cylindrical connector on the pump dispenser that is removably connectable to the bottle to connect the pump dispenser to the bottle, the connector having a lock surface on the connector;

a cylindrical collar on the pump dispenser, the collar being manually rotatable around the pump dispenser between a vent closed position of the collar on the pump dispenser where the collar closes the air vent passage through the pump dispenser and a vent opened position of the collar on the pump dispenser where the collar opens the air vent passage through the pump dispenser;

a dispenser head on the pump plunger, the dispenser head having an outlet passage that communicates with the pump plunger discharge passage and extends radially from the discharge passage, the dispenser head being operatively connected to the collar to rotate with the collar and rotate the pump plunger when the collar is rotated between the vent closed position and the vent opened position, and the dispenser head being connected to the pump plunger to move axially relative to the collar when the pump plunger is moved between the first, charge position and the second, discharge position of the pump plunger relative to the pump housing, the dispenser head having a lock surface on the dispenser head that aligns axially opposite the connector lock surface when the pump plunger is in the first, charge position and the collar is rotated to the closed position where the aligned dispenser head lock surface and connector lock surface prevent the pump plunger moving from the first, charge position to the second, discharge position of the pump plunger relative to the pump housing, and the dispenser head lock surface being axially misaligned with the connector lock surface when the collar is rotated to the opened position enabling the pump plunger to move from the first, charge position to the second, discharge position of the pump plunger relative to the pump housing.

10. The pump dispenser of claim 9, further comprising:

the connector having a vent opening that forms a portion of the air vent passage through the pump dispenser; and, the collar having a sealing surface that covers over and closes the connector vent opening when the collar is rotated with the dispenser head to the locked position of the dispenser head relative to the connector, and is displaced from and opens the connector vent opening when the collar is rotated with the dispenser head to the unlocked position of the dispenser head relative to the connector.

11. The pump dispenser of claim 9, further comprising:

the connector having a wall that extends axially from the pump housing over the pump plunger to a distal end of the wall, and the connector lock surface being on the distal end of the connector wall.

12. The pump dispenser of claim 11, further comprising:

the connector wall being a cylindrical pump chamber wall that extends axially from the pump housing and extends around the pump plunger.

13. The pump dispenser of claim 12, further comprising:

the pump housing containing a liquid pump chamber; and, the connector pump chamber wall surrounding an air pump chamber.

14. The pump dispenser of claim 10, further comprising:

a stop surface on the connector; and, a stop surface on the collar, the collar stop surface being positioned on the collar to engage with the connector stop surface and prevent further rotation of the collar on the connector when the collar is rotated with the dispenser head to the locked position of the dispenser head relative to the connector where the engagement of the collar stop surface with the connector stop surface positively locates the collar sealing surface over the connector vent opening.

15. A pump dispenser that is connectable to a bottle and is manually operated to pump liquid from an interior of the bottle, the pump dispenser comprising:

a pump plunger having a tubular length with a center axis that defines mutually perpendicular axial and radial directions relative to the pump dispenser, the pump plunger having a discharge passage that extends axially through the pump plunger;

an air piston on the pump plunger;

a liquid piston on the pump plunger, the liquid piston being spaced axially from the air piston; a pump housing receiving the pump plunger for axially reciprocating movements of the pump plunger between a first charge position and a second discharge position of the pump plunger relative to the pump housing;

a liquid pump chamber in the pump dispenser, the liquid piston being received in the liquid pump chamber for reciprocating movements of the liquid piston between charge and discharge positions of the liquid piston in the liquid pump chamber in response to the pump plunger moving between the respective charge and discharge positions of the pump plunger;

an air pump chamber in the pump dispenser, the air pump chamber having an air pump chamber wall surrounding the air pump chamber, the air piston being received in the air pump chamber for reciprocating movements of the air piston between charge and discharge positions of the air piston in the air pump chamber in response to the pump plunger moving between the respective charge and discharge positions of the pump plunger;

a vent opening in the pump dispenser, the vent opening communicating an exterior environment of the pump dispenser with the interior of the bottle when the pump dispenser is connected to the bottle;

a cylindrical collar mounted around the air pump chamber wall for rotation of the collar around the air pump chamber between a vent closed position and a vent opened position of the collar relative to the air pump chamber wall, the collar having a surface that covers the vent opening and closes communication of the exterior environment of the pump dispenser with the interior of the bottle when the collar is moved to the closed position, and that is displaced from the vent opening and opens communication of the exterior environment of the pump dispenser with the interior of the bottle when the collar is moved to the opened position;

a dispenser head mounted on the pump plunger for reciprocating movement of the dispenser head with the pump plunger between the first, charge position and the second, discharge position of the pump plunger relative to the pump housing, the dispenser head being connected to the collar for rotational movement of the dispenser head with the collar between the vent closed position and the vent opened position of the collar relative to the air pump chamber wall, the dispenser head having a lock surface that is positioned on the dispenser head where the lock surface is in axial alignment with the air pump chamber wall when the collar is rotated with the dispenser head to the vent closed position of the collar, the axial alignment of the dispenser head lock surface and the air pump chamber wall preventing reciprocating movement of the dispenser head with the pump plunger relative to the pump housing, and where the lock surface is out of axial alignment with the air pump chamber wall when the collar is rotated with the dispenser head to the vent opened position of the collar, the dispenser head lock surface being out of axial alignment with the air pump chamber wall allowing reciprocating movement of the dispenser head with the pump plunger relative to the pump housing.

* * * * *